US005283959A

United States Patent [19]

Nagayoshi et al.

[11] Patent Number: 5,283,959

[45] Date of Patent: Feb. 8, 1994

[54] SYSTEM FOR DRYING MOIST SLUDGE

[75] Inventors: Yoshikazu Nagayoshi; Hajime Nakajima; Misao Igarashi, all of Tokyo, Japan

[73] Assignee: Tsukishima Kikai Kabushiki Kaisha, Tokyo, Japan

[21] Appl. No.: 958,074

[22] Filed: Oct. 7, 1992

[30] Foreign Application Priority Data

Oct. 14, 1991 [JP] Japan ..... 3-331104

[51] Int. Cl.[5] ..... F26B 17/00

[52] U.S. Cl. ..... 34/57 R; 432/58; 34/57 A

[58] Field of Search ..... 34/10, 52 A, 57 R, 57 E, 34/8; 432/58, 13

[56] References Cited

U.S. PATENT DOCUMENTS 3,462,850 8/1969 Gale .
3,793,743 2/1974 Kemmetmueller .
4,501,551 2/1985 Riess et al. .
4,926,764 5/1990 Van Den Broek .

FOREIGN PATENT DOCUMENTS 624375 7/1961 Canada ..... 34/10
379657 8/1990 European Pat. Off. .
410043 1/1991 European Pat. Off. .
2651385 5/1977 Fed. Rep. of Germany .
3819584 1/1989 Fed. Rep. of Germany .
5-15900 1/1993 Japan .

*Primary Examiner*—Henry A. Bennet
*Attorney, Agent, or Firm*—Oldham, Oldham & Wilson Co.

[57] ABSTRACT

A system of drying moist sludge includes a drier as a main component. The drier is composed of a lower gas fluidizing section and an upper high speed fluidizing section. Moist sludge to be be dried is introduced into a mixer in which each particle is coated with the moist sludge, and the coated particles are supplied to the gas fluidizing section. Fine particles flown away from the gas fluidizing section are fluidized in the high speed fluidizing section while they are dried by heating elements. After completion of the drying operation, dried sludge particles are collected in a dust collector. Subsequently, fine dried sludge particles are conducted to a bag type dust collecting unit from which they are discharged to a sludge hopper. A part of the coarse dried sludge particles collected in the dust collector is supplied to the gas fluidizing section, a part of the same is supplied to the mixer to be mixed with moist sludge, and the balance is delivered to the sludge hopper. The gas exhausted from the bag type dust collecting unit is introduced into the gas fluidizing section as fluidizing gas. A part of the exhausted gas is extracted to the outside by a quantity substantially equal to that of the gas vaporized from the moist sludge.

15 Claims, 3 Drawing Sheets

SYSTEM FOR DRYING MOIST SLUDGE

BACKGROUND OF THE INVENTION

1. Field of the Invention

The present invention relates generally to a system for drying moist sludge in the form of pulverized dried sludge in order to treat moist sludge arising in a chemical plant, a sewage treating station or the like in a gas flow type combustion furnace and a swirl flow type melting furnace. More particularly, the present invention relates to a system of the aforementioned type preferably employable as a preliminary station prior to treatment of the sludge by burning and then melting it in these furnaces.

2. Description of the Related Art

When moist sludge containing organic substances such as sludge arising from industrial waste in a chemical plant, sludge arising in a sewage treating station or the like is burnt at an elevated temperature and the residue remaining on completion of the combustion is then treated in a swirl flow type melting furnace by melting it, it is necessary that the residue in the form of particles has a particle size of 700 μm or less. To satisfy the necessity, moist sludge is hitherto first dried in a drier such as a flush drier, a disc type drier or the like, and the dried sludge is then in a crusher until a particle size of the crushed particles remain within a predetermined range. However, this conventional process requires a high magnitude of crushing power for driving the crusher, and moreover, a stator and associated rotational components in the crusher severely wear within a short period of time. In addition, an expensive maintenance cost is required for properly operating the crusher.

A process of drying moist sludge in a fluidized bed type drier has been already employed. However, with this conventional process having dried granular sludge used as a fluidizing medium, the dried sludge cannot be crushed to a fine particle size of 700 μm or less enough to enable it to be supplied to a swirl flow type melting furnace. For this reason, there arises a necessity that the dried sludge is crushed in a certain type of crusher after completion of a drying operation, resulting in the same drawbacks as mentioned above occurring.

SUMMARY OF THE INVENTION

The present invention has been made with the foregoing background in mind.

An object of the present invention is to provide a system for drying moist sludge wherein dried sludge particles each having a particle size of 700 μm or less can be obtained at a high efficiency without any necessity for arranging a crusher.

According to one aspect of the present invention, there is provided a system for drying moist sludge, wherein the system comprises a drier including a first fluidizing section and a second fluidizing section arranged above the first fluidizing section in which particles each having a comparatively large particle size are fluidized and from which particles each having a comparatively small particle size are flown away into the second fluidizing section having a gas flow area smaller than that of the first fluidizing section; first particle collecting means arranged downstream of the drier to collect dried coarse sludge particles flown away from the second fluidizing section; second particle collecting means arranged downstream of the first particle collecting means to collect dried fine sludge particles flown away from the first particle collecting means; a mixer arranged in the vicinity of the drier so as to allow moist sludge and particles each having a comparatively large particle size to be mixed and stirred with each other so as to prepare particles to be fluidized in the first fluidizing section, each of the particles being such that it is coated with moist sludge; and a dried sludge hopper for receiving dried sludge particles from the first particle collecting means and the second particle collecting means.

To dry the sludge particles flown away from the first fluidizing section, a plurality of heating elements are arranged in the spaced relationship in the second fluidizing section of the drier.

It is recommendable that each of the heating elements is constructed in the form of a hollow plate-shaped element having a plurality of horizontally extending partitions arranged in the zigzag-shaped contour so as to allow steam to be supplied thereto from the upper end thereof.

Generally, a ratio of the gas flow area of the second fluidizing section to that of the first gas fluidizing section is set to 0.2 to 0.7.

In addition, it is recommendable that the mixer is constructed in the form of a double-shaft puddle mixer including two shafts adapted to rotate in the opposite direction to each other wherein a plurality of puddles are arranged on each of the shafts in the spaced relationship in the axial direction.

A characterizing feature of the present invention consists in that a part of the dried sludge particles collected in the first particle collecting means is supplied to the first fluidizing section, a part of the same is supplied to the mixer to be mixed with moist sludge, and the balance is delivered to the sludge hopper.

It is preferable that the first particle collecting means is constructed in the form of a cyclone.

In addition, it is preferable that the second particle collecting means is constructed in the form of a bag type collecting unit.

Another characterizing feature of the present invention consists in that the gas exhausted from the second particle collecting means is supplied to the first fluidizing section of the drier as fluidizing gas, and that a part of the gas exhausted from the second particle collecting means is discharged to the outside by a quantity substantially equal to that of the gas vaporized from the supplied moist sludge.

Usually, a moisture content of the dried sludge particles collected in the sludge hopper is adjusted to be 10% or less and a particle size of the same is adjusted to be 700 μm or less.

Further, according to other aspect of the present invention, there is provided a system for drying moist sludge, wherein the system comprises the steps of supplying moist sludge to a mixer to be mixed with particles each having a comparatively large particle size so as to allow each particle to be coated with the moist sludge; supplying particles each having a comparative large particle size to a first fluidizing section of the drier; blowing fluidizing gas to the first fluidizing section of the drier; fluidizing the particles in the first fluidizing section; fluidizing particles each having a comparatively small particle size flown away from the first fluidizing section in a second fluidizing section arranged above the first fluidizing section while drying the particles with the aid of a plurality of heating elements; discharging dried particles to first particle collecting means; conducting fine particles collected in the first particle collecting means to second particle collecting means; supplying a part of coarse particles collected in the first particle collecting means to the first fluidizing section, supplying a part of the same to the mixer to be mixed with moist sludge, and delivering the balance to a sludge hopper; discharging fine particles collected in the second particle collecting means to the sludge hopper; and exhausting gas from the second particle collecting means so as to allow it to be delivered to the first fluidizing section as fluidizing gas.

The system further includes a step of extracting a part of the gas exhausted from the second particle collecting means by a quantity substantially equal to that of the gas vaporized from the supplied moist sludge.

It is preferable that the extracted gas is cooled in a scrubber by water cooling, and moreover, odoring substances in the extracted gas is decomposed in a deodoring furnace.

Other objects, features and advantages of the present invention will become apparent from reading of the following description which has been made in conjunction with the accompanying drawings.

BRIEF DESCRIPTION OF THE DRAWINGS

The present invention is illustrates in the following drawings in which.

DESCRIPTION OF THE PREFERRED EMBODIMENT

The present invention will now be described in detail hereinafter with reference to the accompanying drawings which illustrate a preferred embodiment thereof.

Figure 1:
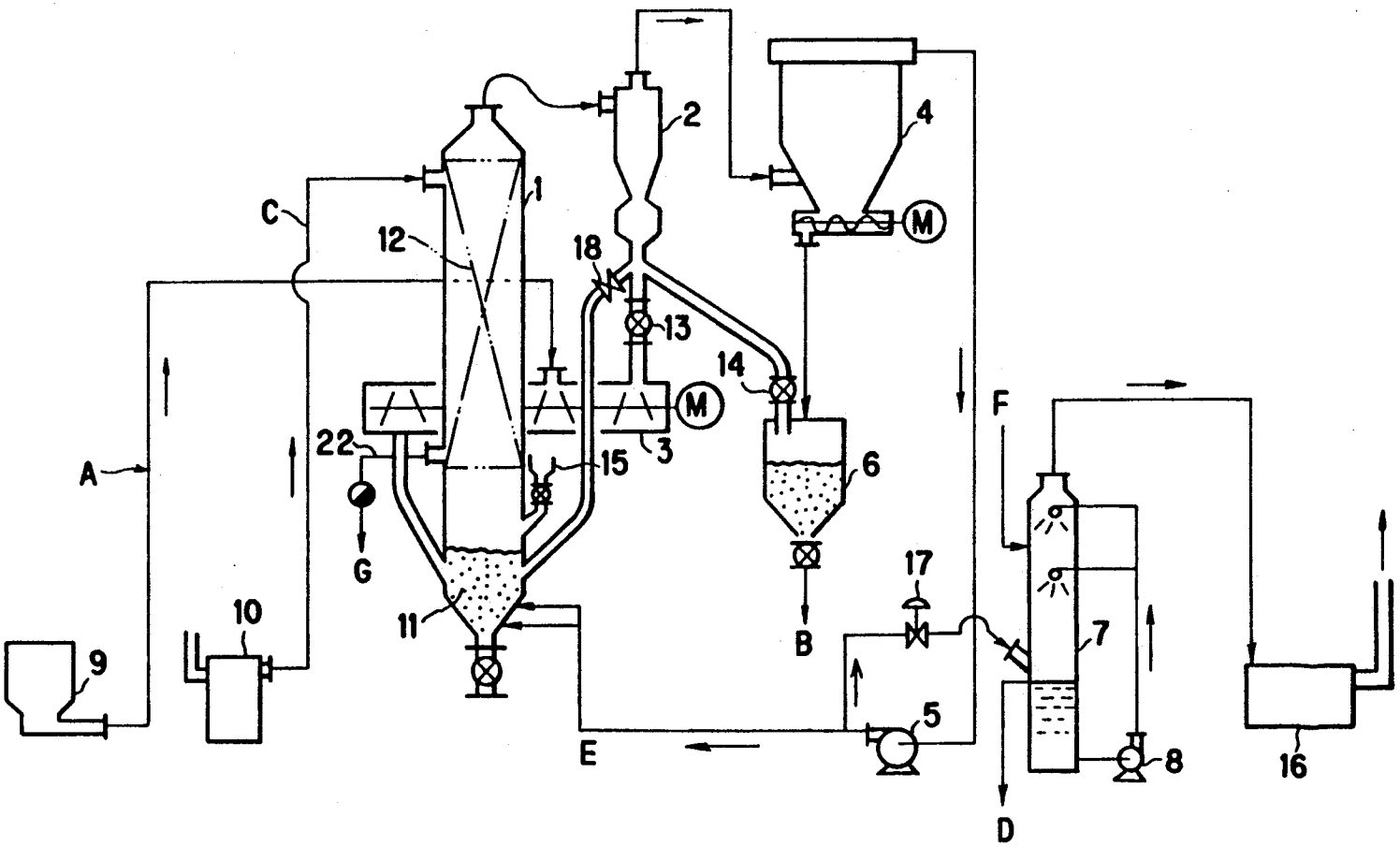
FIG. 1 is a flow sheet which schematically illustrates the structure of a system for drying moist sludge in accordance with an embodiment of the present invention.
Figure 2:
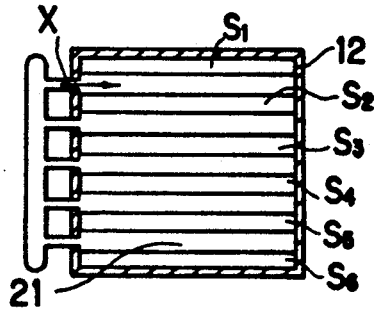
FIG. 2 is a sectional plan view of a drier for the system taken along line II—II in FIG. 3.
Figure 3:
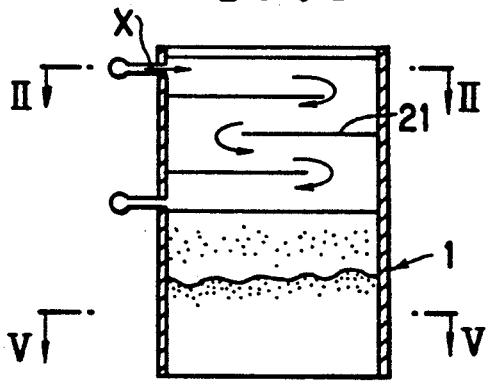
FIG. 3 is a vertical sectional view of the drier shown in FIG. 2.
Figure 4:
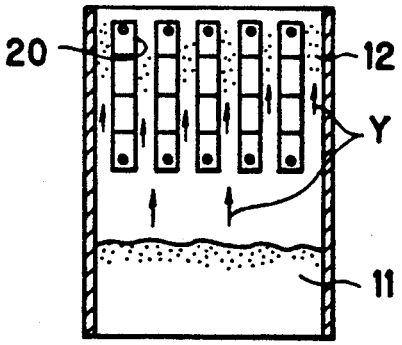
FIG. 4 is a vertical sectional view of the drier as seen on a plane turned by an angle of 90 degrees relative to FIG. 3.
Figure 5:
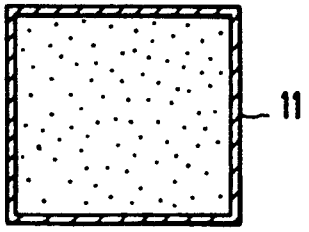
FIG. 5 is a cross-sectional view of the drier taken along line V—V in FIG. 3.

FIG. 1 is a flow sheet which schematically illustrate the structure of a system for drying moist sludge in accordance with the embodiment of the present invention. As shown in the drawing, the system includes a drier as a main component. The drier 1 is constructed of a lower gas fluidizing section 11 and an upper high speed fluidizing section 12. FIG. 2 to FIG. 5 show by way of sectional views the interior structure of the drier 1. Specifically, FIG. 2 is a cross-sectional view of the upper high speed fluidizing section 12, FIG. 3 is a vertical sectional view of the drier 1, FIG. 4 is a vertical sectional view of the drier 1 which is turned by an angle of 90 degrees relative to FIG. 3, and FIG. 5 is a cross-sectional view of the lower gas fluidizing section 11. As is best seen from FIG. 4, five hollow plate-shaped heating elements 20 are vertically arranged in the equally spaced relationship in the high speed fluidizing section 12. Each heating element 20 includes a plurality of horizontally extending partition plates 21 which are arranged to exhibit a zigzag structure as shown in FIG. 3, and the upper end of each heating element 20 is communicated with a package boiler 10. As steam C is generated in the package boiler 10, it is supplied to each heating element 20 at a pressure ranging from 4 to 10 $kg/cm^2G$ as represented by a X-arrow mark in FIG. 2. The lower end of each heating element 20 is communicated with a drain discharge pipe 22 so that drain G is discharged to the outside via the drain discharge pipe 22. As shown in FIG. 4, heat exchanging is achieved between the steam C and the fluidizing gas flowing upward of the lower gas fluidizing section 11 as represented by Y-arrow marks to dry sludge particles. When a gas flow area between outer heating element 20 and the inner wall of the high speed fluidizing section 12 as well as adjacent heating elements 20 is designated by $S_1$ to $S_6$ as shown in FIG. 2, the total gas flow area S(1) of the high speed fluidizing section 12 is represented by an equation of $S(1)=S_1+S_2+S_3+S_4+S_5+S_6$. In addition, when a gas flow area of the gas fluidizing section 11 is designated by S(2), a ratio of the gas flowing area of the gas fluidizing section 11 to that of the high speed fluidizing area is represented by S(1)/S(2). Usually, the foregoing ratio is set to 0.2 to 0.7. In this connection, reference should be made to Table 1 which will be described later to show results obtained from experiments conducted to confirm operational reliability of the system.

Dried sludge particles each having a particle size of 700 μm or less to serve as a seed for a particle coated with moist sludge and/or fluidizing particles each having a comparatively large particle size are introduced into the drier 1 by driving a feeder 15. Usually, natural inorganic particles such as quartz sand, granular calcium carbonate or the like or artificial inorganic particles such as glass beads or the like each having an average grain size of 700 to 1000 μm and a true specific gravity of 2.0 to 3.0 are employed as a fluidizing medium. The fluidizing medium is previously sifted such that its specific mesh size remains within a predetermined range. In addition, it is desirable to previously remove from the fluidizing medium fine particles each having a very fine particle size which easily fly away from the drier 1 together with the gas flow. Incidentally, both of the dried sludge particles and the fluidizing medium may be used together or only one of them may be used. The fluidizing medium may assist or may not assist to crush the dried sludge particles depending on the kind of moist sludge to be dried. Both or one of the dried sludge particles and the fluidizing medium are used or are not used depending on the present state of availability and the present crushing state.

Figure 6:
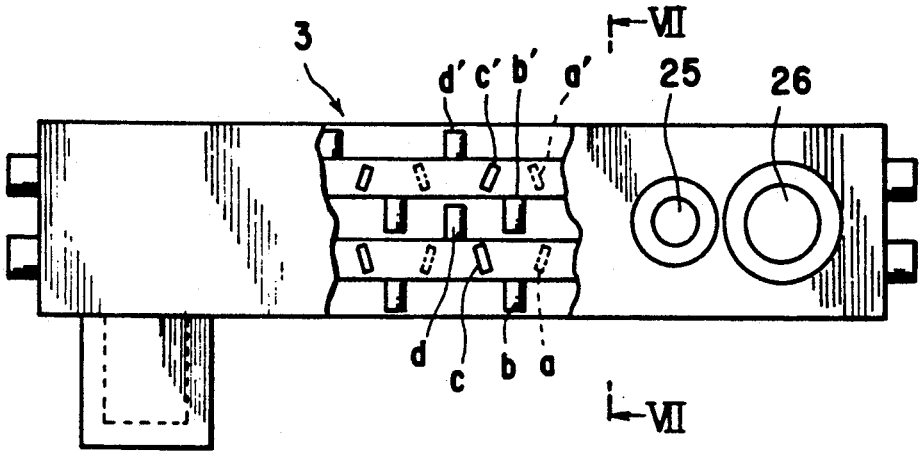
FIG. 6 is a partially exploded plan view of a mixer for the system.
Figure 7:
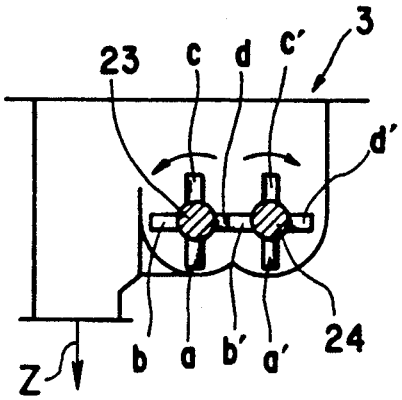
FIG. 7 is a cross-sectional view of the mixer taken along line VII—VII in FIG. 6.

Moist sludge A is supplied to a mixer 3 by driving a sludge pump 9. The mixer 3 is designed in a double-shaft puddle type, and the inner structure of the mixer 3 is as illustrated in FIG. 6 and FIG. 7. FIG. 6 is a plan view of the mixer 3 of which part is exploded, and FIG. 7 is a sectional view of the mixer 3 taken along line A—A in the upper view. Specifically, the mixer 3 includes shafts 23 and 24 which are rotated in the opposite direction to each other. A plurality of puddles a, b, c, d - - - are arranged on the shaft 23 in the spaced relationship as seen in the axial direction, while a plurality of puddles a', b', c', d'- - - are likewise arranged on the shaft 24 in the spaced relationship as seen in the axial direction, whereby the moist sludge A supplied through a sludge inlet port 25 and dried sludge particles supplied through a particle supply port 26 are well mixed together in the mixer 3 by the vigorous puddling action caused by these puddles.

After completion of the mixing operation, the resultant mixture in the form of particles each coated with moist sludge is introduced into the gas fluidizing section 11 of the drier 1 in the Z arrow-marked direction in FIG. 7. As fluidizing gas E is supplied to the lower part of the gas fluidizing section 11, particles each having a comparatively large particle size are continuously fluidized in the gas fluidizing section 11 but particles each having a comparatively small particle size are displaced upward from the gas fluidizing section 11 into the high speed fluidizing section 12 while maintaining the high speed fluidizing state. Thus, the smaller sludge particles are dried by heat received from the heating elements 20 and then fly to the outside from the top of the drier 1. The particles which have flown away from the drier 1 are collected in a dust collector 2 such as a cyclone or the like. The very fine particles which have failed to be collected in the dust collector 2 fly further away from the dust collector 2 but they are collected in a dust collecting unit 4 such as a bag type dust collector or the like. The particles collected in the dust collecting unit 4 are delivered to a dried sludge hopper 6 from which they are discharged to the outside as a product of fine sludge particles B.

A part of the particles collected in the dust collector 2 is fed to the mixer 3 via a feeder 13, e.g., a rotary valve, and after it is stirred and mixed with the moist sludge A delivered from the sludge pump 9, it is supplied to the gas fluidizing section 11. In addition, a part of the particles collected in the dust collector 2 is supplied directly to the gas fluidizing section 11 via a control valve 18 for properly controlling a quantity of particles so as to allow the drier 1 to be normally filled with a constant quantity of particles. On the other hand, the remaining particles are delivered to the dried sludge hopper 6 via an extractor 14 such as a rotary valve or the like, and the dried sludge B is then discharged to the outside from the bottom of the dried sludge hopper 6. The gas E flown from the dust collector 4 is recirculated to the drier 1 with the aid of a blower 5. It should be noted that a part of the gas E substantially equal to a quantity of the gas vaporized from the supplied moist sludge A is extracted from the recirculation line and then delivered to a scrubber 7 via a bypass pressure control valve 17. Cooling water F is sprayed from above in the scrubber 7, while the water F collected in the bottom of the scrubber 7 is pumped up by a water recirculating pump 8 and then sprayed again from above to cool the hot gas. The condensed water is extracted from the scrubber 7 as waste water D and then drained to the outside therefrom. Since the gas leaving the scrubber 7 contains odoring substances, it is delivered to a deodoring furnace 16 in which the odoring substances are thermally decomposed at an elevated temperature.

To confirm the operational reliability of the system, the inventor conducted experiments under different working conditions. The results obtained from the experiments are shown in Table 1.

TABLE 1

| item | experiment 1 | experiment 2 | experiment 3 |
|---|---|---|---|
| kind of sludge | digested | digested | mixed raw |

TABLE 1-continued

| item | experiment 1 | experiment 2 | experiment 3 |
|---|---|---|---|
| | sludge | sludge | sludge |
| quantity of processed sludge (kg/hr) | 33.0 | 46.0 | 50.0 |
| steam pressure (kg/cm$^2$ G) | 5.0 | 7.8 | 6.0 |
| steam temperature (°C.) | 158 | 174 | 164 |
| ratio (S(1)/S(2)) of gas flow area through gas fluidizing section 11 to that through high speed fluidizing section 12 | 0.56 | 0.45 | 0.21 |
| gas flow speed through gas fluidizing section 11 (m/sec) | 2.8 | 2.2 | 1.0 |
| gas flow speed through high speed fluidizing section 12 (m/sec) | 5.0 | 4.9 | 4.8 |
| moisture content of dried sludge (%) | 2.0 | 1.2 | 1.5 |
| average particle size of dried sludge (μm) | 190 | 220 | 200 |
| total heat transfer coefficient (Kcal/m$^2$ Hr °C.) | 100 | 95 | 90 |

It should be added that in these experiments, the total surface area of each heating element 20 was set to 8.4 m$^2$.

In addition, the inventors conducted experiments for comparing the system of the present invention with the conventional system, and the results obtained from the comparative experiments are shown in Table 2. In practice, the comparative experiments were conducted such that sludge having a moisture content of 80% was dried to a moisture content of 5% in order to obtain dried sludge particles each having a predetermined particle size by operating an existent sludge drying installation having a working capacity of 100 tons per day.

TABLE 2

| item | system of present invention | conventional system |
|---|---|---|
| main dimensions of drier (mm) | 1400 in diameter × 10000 in height | 4500 in diameter × 6000 in height |
| surface area of heat conduction (m$^2$) | 300 | 400 |
| power consumption (kwH) | 180 | 270 |
| total installation area (m$^2$) | 100 | 150 |

As is apparent from the results shown in the tables, the system of the present invention can be operated with smaller dimensions while consuming a small quantity of power.

In addition, with the system for drying moist sludge according to the present invention, dried sludge particles each having a moisture content of 10% or less and a particle size of 700 μm or less can be obtained at a high efficiency without any necessity for a process of crushing dried sludge using a crusher.

While the present invention has been described above with respect to a single preferred embodiment thereof, it should of course be understood that the present invention should not be limited only to this embodiment but various change or modification may be made without departure from the scope of the present invention as defined by the appended claims.

What is claimed is:

1. A system for drying moist sludge, comprising:

a dryer including a first fluidizing section and a second fluidizing section arranged above said first fluidizing section in which sludge-coated fluidizing particles, each having a comparatively large particle size are fluidized, and from which sludge-coated particles, each having a comparatively small particle size, are flown away into said second fluidizing section having a gas flow area smaller than that of said first fluidizing section, a first particle collecting means arranged downstream of said dryer to collect dried coarse sludge-coated particles flown away from said second fluidizing section, a second particle collecting means arranged downstream of said first particle collecting means to collect dried fine sludge-coated particles flown away from said first particle collecting means;

a mixer arranged in the vicinity of said dryer so as to allow the moist sludge and a fluidizing particle, each having a comparatively large particle size to be mixed and stirred with each other so as to prepare the sludge-coated particles to be fluidized in the first fluidizing section; and a dried sludge hopper for receiving dried sludge particles from said first particle collecting means and said second particle collecting means.

2. The system according to claim 1, wherein a plurality of heating elements are arranged in the spaced relationship in said second fluidizing section of said dryer to heat the sludge-coated particles flown away from said first fluidizing section.

3. The system according to claim 2, wherein each of said heating elements is constructed in the form of a hollow plate-shaped element having a plurality of horizontally extending partitions arranged in the zigzag-shaped contour so as to allow steam to be supplied thereto from the upper end thereof.

4. The system according to claim 1, wherein a ratio of the gas flow area of said second fluidizing section to that of said first gas fluidizing section is set to 0.2 to 0.7.

5. The system according to claim 1, wherein said mixer is constructed in the form of a double-shaft puddle mixer including two shafts adapted to rotate in the opposite direction to each other, each of said shafts having a plurality of puddles arranged thereon in the spaced relationship in the axial direction.

6. The system according to claim 1, wherein a part of the dried sludge particles collected in said first particle collecting means is supplied to said first fluidizing section as fluidizing particles, a part of the same is supplied to said mixer to be used as particles to be mixed with moist sludge and the balance is delivered to said sludge hopper.

7. The system according to claim 1, wherein said first particle collecting means is a cyclone.

8. The system according to claim 1, wherein said second particle collecting means is a bag type dust collecting unit.

9. The system according to claim 1, wherein the gas exhausted from said second particle collecting means is supplied to said first fluidizing section of said dryer as fluidizing gas.

10. The system according to claim 1, wherein a part of the gas exhausted from said second particle collecting means is discharged to the outside by a quantity substantially equal to that of the gas vaporized from the supplied moist sludge.

11. The system according to claim 1 wherein a moisture content of the dried sludge particles collected in said sludge hopper is adjusted to be 10% or less and a particle size of the same is adjusted to be 700 μm or less.

12. A system for drying moist sludge, comprising the steps of:

supplying moist sludge to a mixer to be mixed with fluidizing particles, each having a comparatively large particle size so as to allow each particle to be coated with said moist sludge thereby forming sludge-coated particles;

blowing fluidizing gas to said first fluidizing section of said dryer;

fluidizing said sludge-coated particles in a first fluidizing section;

fluidizing sludge-coated particles, each having a comparatively small particle size flown away from said first fluidizing section into a second fluidizing section arranged above said first fluidizing section while drying said sludge-coated particles with the aid of a plurality of heating elements;

discharging dried sludge-coated particles to said first particle collecting means;

conducting fine sludge-coated particles collected in said first particle collecting means to said second particle collecting means;

supplying a part of said coarse sludge-coated particles collected in said first particle collecting means to said first fluidizing section as sludge-coated particles collected in said first particle collecting means to said first fluidizing section as sludge-coated fluidizing particles supplying a part of the same to said mixer to be mixed with moist sludge, and delivering the balance to a sludge hopper;

discharging fine sludge-coated particles collected in said second particle collecting means to said sludge hopper; and exhausting gas from said second particle collecting means so as to allow it to be delivered to said first fluidizing section as fluidizing gas.

13. The system according to claim 12 further including a step of extracting a part of the gas exhausted from said second particle collecting means by a quantity substantially equal to that of the gas vaporized from the supplied moist sludge.

14. The system according to claim 13, wherein the extracted gas is cooled in a scrubber by water cooling.

15. The system according to claim 13 wherein odoring substances in the extracted gas are decomposed in a deodoring furnace.

* * * * *